US005733346A

United States Patent [19]

Davies et al.

[11] Patent Number: 5,733,346

[45] Date of Patent: Mar. 31, 1998

[54] OIL ADDITIVES AND COMPOSITIONS

[75] Inventors: Brian William Davies, Oxfordshire, United Kingdom; Alessandro Lombardi, Brussels, Belgium; Rinaldo Caprotti, Oxford, United Kingdom

[73] Assignee: Exxon Chemical Patents Inc., Wilmington, Del.

[21] Appl. No.: 737,973

[22] PCT Filed: May 26, 1995

[86] PCT No.: PCT/EP95/02037

§ 371 Date: Jan. 10, 1997

§ 102(e) Date: Jan. 10, 1997

[87] PCT Pub. No.: WO95/33021

PCT Pub. Date: Dec. 7, 1995

[30] Foreign Application Priority Data

May 31, 1994 [GB] United Kingdom ..... 9410820

[51] Int. Cl.[6] ..... C10L 1/14; C10L 1/22

[52] U.S. Cl. ..... 44/320; 44/408; 44/418; 44/410

[58] Field of Search ..... 44/320, 408, 418, 44/410

[56] References Cited

U.S. PATENT DOCUMENTS

| | | | |
|---|---|---|---|
| 3,384,600 | 5/1968 | Domba | 44/320 |
| 3,589,877 | 6/1971 | Balash | 44/320 |
| 5,397,367 | 3/1995 | Fey et al. | 44/320 |
| 5,435,811 | 7/1995 | Fey et al. | 44/320 |
| 5,474,709 | 12/1995 | Herzy et al. | 44/320 |

FOREIGN PATENT DOCUMENTS

| | | |
|---|---|---|
| 0482253 | 4/1992 | European Pat. Off. . |
| 94/06894 | 3/1994 | WIPO . |

*Primary Examiner*—Jacqueline V. Howard
*Attorney, Agent, or Firm*—Ohlandt, Greeley, Ruggiero & Perle

[57] ABSTRACT

Oil-soluble polar nitrogen components are used in combination with fuel oil antifoams to control foaming in fuel oils.

18 Claims, No Drawings

OIL ADDITIVES AND COMPOSITIONS

This invention relates to oil compositions, primarily to fuel oil compositions, and more especially to the control of foaming in such compositions.

In the processing and transport of liquid fuels, foaming frequently occurs as the fuel is passed from one vessel to another. The foaming may interfere with the pumping of the fuel, and may be such as to require a reduction in pumping rate to allow foam collapse to avoid fuel spills. It is desirable to control foaming to permit higher rates of fuel transfer. U.S. Pat. No. 3,233,986 describes certain organosilicon compounds as additives for reducing the foaming tendency of organic liquids such as liquid hydrocarbon fuels. Additives having the ability to reduce foaming tendency are generally known as "antifoams".

A problem in using antifoams is that relatively large proportions thereof may be needed to give rise to a desired antifoaming effect.

It has now surprisingly been found that less antifoam is needed to achieve a given antifoaming effect if the antifoam is used in combination with certain other additives such as polar nitrogen compounds. UK-A-1538 578; EP-A-061 894; EP-A-104 015; and EP-A-155 171 are examples of specifications describing the use of polar nitrogen compounds as additives in fuel oils, and EP-A-316,108 describes the anti-foaming characteristics of certain substituted amino-sulphosuccinates in diesel fuels.

EP-A-316,108 describes said anti-foam characteristics alone and in combination with an ethylene/propylene copolymer or with an ethylene/vinyl acetate copolymer, where the additive component concentrations are 116 ppm. It also compares said characteristics with those of a diesel fuel containing an unspecified conventional silicone anti-foam.

A first aspect of the invention is a fuel oil composition comprising a major proportion of a fuel oil and a minor proportion of a combination of additive components (A) and (B) wherein (A) comprises a fuel oil antifoam, and (B) comprises an oil-soluble polar nitrogen compound carrying one or more, preferably two or more, substituents of the formula —$NR^1$—, where $R^1$ represents a hydrocarbyl group containing 8 to 40 carbon atoms, which substituent or one or more of which substituents may be in the form of a cation derived therefrom.

Component (B) is found to enhance the antifoaming effect of component (A) in both the senses of acceleration of foam collapse and reduced initial foam height. Thus, the invention enables less of component (A) to be used to achieve a desired antifoam effect.

Second and third aspects of the invention are use of the combination of additives (A) and (B) to enhance the anti-foaming properties of a fuel oil and use of additive (B) to enhance the antifoaming properties of additive (A) in a fuel oil, additives (A) and (B) being defined as above.

The features of the invention will now be described in more detail as follows:

FUEL OIL

The fuel oil may be a petroleum-based fuel oil, suitably a middle distillate fuel oil, i.e. a fuel oil obtained in refining crude oil as the fraction between the lighter kerosene and jet fuels fraction and the heavier fuel oil fraction. Such distillate fuel oils generally boil within the range of about 100° C. to about 500° C., e.g. 150° to about 400° C. (ASTM-D86). The fuel oil can comprise atmospheric distillate or vacuum distillate, or cracked gas oil or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oils or of both.

Heating oils may be made of a blend of virgin distillate, e.g. gas oil, naphtha, etc. and cracked distillates, e.g. catalytic cycle shock. A representative specification for a diesel fuel includes a minimum flash point of 38° C. and a 90% distillation point between 282° and 338° C. (see ASTM Designations D-396 and D-975).

The fuel oil may be an animal, vegetable or mineral oil or a combination thereof.

COMPONENT (A)

The antifoam is advantageously insoluble in the fuel being treated but is dispersible therein to form a stable dispersion, if necessary with the aid of a suitable dispersant or solvent, with or without the use of mechanical dispersing aids.

As antifoam there may be used a siloxane-containing composition. Such a composition is advantageously a block copolymer containing siloxane blocks and polyoxyalkylene blocks. The siloxane blocks advantageously contain at least two groups of the formula $$R_bSiO_{\frac{4-b}{2}}$$

where R represents a hydrocarbyl or hydrocarbylene group, and b has a value within the range of from 1 to 4, the ratio of hyrocarbyl or hydrocarbylene groups to silicon atoms being from 1:1 to 3:1.

The polyoxyalkylene blocks advantageously contain at least two polyoxyalkylene groups, preferably from 4 to 30 such groups. Advantageously at least 60% by weight of the polyoxyalkylene blocks are represented by oxyethylene or oxypropylene units. The block copolymers are advantageously prepared as described in U.S. Pat. No. 3,233,986, the disclosure of which is incorporated by reference herein.

Examples of such a polyether polymethyl siloxane copolymer compositions are available commercially. DE-C-4, 343, 235 describes polysiloxanes with methyl and polar organic substituents that are used to defoam diesel fuel. Other examples of silicon-containing antifoams are silicone terpolymers comprising a silicone backbone co-grafted with a phenol derivative (especially eugenol) as well as a polyether, as described in U.S. Pat. No. 5,334,227.

There may alternatively be used an ashless antifoam, for example, a carboxylated polyamine, especially one that is a reaction product of a polyamine of the formula $$NH_2—R^{21}—[—NH—R^{22}—]_x—[NH—R^{23}]_y—NH_2$$

with a monocarboxylic acylating agent of the formula $$R^{24}COX$$

wherein, $R^{21}$, $R^{22}$ and $R^{23}$, which may be the same of different, represent hydrocarbylene groups and $R^{24}$ represents a hydrocarbyl group, X is a leaving group, and x and y are integers whose sum is in the range of 0 to 10. As used in this specification, the term "ashless" refers to an organic material that forms substantially no ash on combustion. WO 94/06894 describes examples of such ashless antifoams.

As used in this specification the term "hydrocarbyl" refers to a group having a carbon atom directly attached to the rest of the molecule and having a hydrocarbon or predominantly hydrocarbon character.

Among these, there may be mentioned hydrocarbon groups, including aliphatic, (e.g., alkyl or alkenyl), alicyclic (e.g., cycloalkyl or cycloalkenyl), aromatic, aliphatic- and alicyclic-substituted aromatics, and aromatic-substituted aliphatic and alicyclic groups. Aliphatic groups are advantageously saturated. Examples include methyl, ethyl, propyl, butyl, isobutyl, pentyl, hexyl, octyl, decyl, octadecyl, cyclohexyl, and phenyl. These groups may, as indicated above, contain non-hydrocarbon substituents provided they do not alter the predominantly hydrocarbon character of the group. Examples include keto, halo, hydroxy, nitro, cyano, alkoxy and acyl. If the hydrocarbyl group is substituted, a single (mono) substituent is preferred. Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, oxygen and sulfur.

The term "hydrocarbylene" is used analogously. Advantageously such a group is attached at both valences to the rest of the molecule by carbon atoms.

Advantageously, the polyamine is a polyalkylene polyamine or a hydroxyalkyl polyamine, for example, 1,2-diaminobutan-4-ol.

Advantageously, the acylating agent is a fatty acid, e.g., stearic, oleic or cekanoic acid, or a coco fatty acid fraction. Advantageously, the reaction product is formed by reaction between one mole of polyamine and at least two moles of acylating agent, and preferably the amine groups of the polyamine are completely acylated.

Examples of suitable products are the reaction product of 1,2-diaminobutan-4-ol and a coco-fatty acid fraction, or an N-[2-(2-heptadecyl-4,5-dihydro-1H imidazol-1-yl)ethyl] alkamide, e.g., lauramide.

COMPONENT (B)

The oil-soluble polar nitrogen compound is either ionic or non-ionic and is capable of acting as a wax crystal growth inhibitor in fuels. It comprises for example one or more of the compounds (i) to (iii) as follows:

(i) An amine salt and/or amide formed by reacting at least one molar proportion of a hydrocarbyl substituted amine with a molar proportion of a hydrocarbyl acid having 1 to 4 carboxylic acid groups or its anhydride, the substituent(s) of formula —$NR^1$—being of the formula —$NR^1R^2$ where $R^1$ is defined as in the first aspect of the invention and $R^2$ represents hydrogen or $R^1$, provided that $R^1$ and $R^2$ may be the same of different, said substituents constituting part of the amine salt and/or amide groups of the compound.

Ester/amides may be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally contains about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but preferably are secondary. Tertiary and quaternary amines can only form amine salts. Examples of amines include tetradecyl amine, cocoamine, and hydrogenated tallow amine. Examples of secondary amines include dioctacedyl amine and methyl-behenyl amine. Amine mixtures are also suitable such as those derived from natural materials. A preferred amine is a secondary hydrogenated tallow amine of the formula $HNR^1R^2$ wherein $R^1$ and $R^2$ are alkyl groups derived from hydrogenated tallow fat composed of approximately 4% $C_{14}$, 31% $C_{16}$, 59% $C_{18}$.

Examples of suitable carboxylic acids and their anhydrides for preparing the nitrogen compounds include cyclohexane 1,2 dicarboxylic acid, cyclohexene 1,2 dicarboxylic acid, cyclopentane 1,2 dicarboxylic acid and naphthalene dicarboxylic acid, and 1,4-dicarboxylic acids including dialkyl spirobislactone. Generally, these acids have about 5–13 carbon atoms in the cyclic moiety. Preferred acids useful in the present invention are benzene dicarboxylic acids such as phthalic acid, isophthalic acid, and terephthalic acid. Phthalic acid or its anhydride is particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates such as described in EP-A-327,423.

(ii) A chemical compound comprising or including a cyclic ring system, the compound carrying at least two substituents of the general formula (1) below on the ring system $$—A—NR^1R^2 \qquad (I)$$

where A is an aliphatic hydrocarbyl group that is optionally interrupted by one or more hetero atoms and that is straight chain or branched, and $R^1$ is defined as above and $R^2$ is independently $R^1$.

Preferably, A has from 1 to 20 carbon atoms and is preferably a methylene or polymethylene group.

The term "hydrocarbyl" is defined as above.

The cyclic ring system may include homocyclic, heterocyclic, or fused polycyclic assemblies, or a system where two or more such cyclic assemblies are joined to one another and in which the cyclic assemblies may be the same or different. Where there are two or more such cyclic assemblies, the substituents of the general formula (I) may be on the same or different assemblies, preferably on the same assembly. Preferably, the or each cyclic assembly is aromatic, more preferably a benzene ring. Most preferably, the cyclic ring system is a single benzene ring when it is preferred that the substituents are in the ortho or meta positions, which benzene ring may be optionally further substituted.

The ring atoms in the cyclic assembly or assemblies are preferably carbon atoms but may for example include one or more ring N, S or O atom, in which case or cases the compound is a heterocyclic compound.

Examples of such polycyclic assemblies include (a) condensed benzene structures such as naphthalene, anthracene, phenanthrene, and pyrene;

(b) condensed ring structures where none of or not all of the rings are benzene such as azulene, indene, hydroindene, fluorene, and diphenylene oxide;

(c) rings joined "end-on" such as diphenyl;

(d) heterocyclic compounds such as quinoline, indole, 2:3 dihydroindole, benzofuran, coumarin, isocoumarin, benzothiophen, carbazole and thiodiphenylamine;

(e) non-aromatic or partially saturated ring systems such as decalin (i.e. decahydronaphthalene), alpha-pinene, cardinene, and bornylene; and (f) three-dimensional structures such as norbornene, bicycloheptane (i.e. norbornane), bicyclooctane, and bicyclooctene.

Each hydrocarbyl group constituting $R^1$ and $R^2$ (Formula I) may for example be an alkyl or alkylene group or a mono- or poly-alkoxyalkyl group. Preferably, each hydrocarbyl group is a straight chain alkyl group. The number of carbon atoms in each hydrocarbyl group is preferably 16 to 40, more preferably 16 to 24.

Also, it is preferred that the cyclic system is substituted with only two substituents of the general formula (I) and that A is a methylene group.

Examples of salts of the chemical compounds are the acetate and the hydrochloride.

The compounds may conveniently be made by reducing the corresponding amide which may be made by reacting a secondary amine with the appropriate acid chloride. Examples of such compounds are described in WO 9304148 (PCT/EP92101924).

(iii) A condensate of a primary amine of formula $R^1NH_2$ or a secondary amine of formula $R^1R^2$—NH with a carboxylic acid-containing polymer where $R^1$ is defined as above and $R^2$ is independently $R^1$.

Specific examples include polymers such as described in GB-A-2,121,807, FR-A-2,592,387 and DE-A-3,941,561; and also esters of telemer acid and alkanoloamines such as described in U.S. Pat. No. 4,639,256; and the reaction product of an amine containing a branched carboxylic acid ester, an epoxide and a mono-carboxylic acid polyester such as described in U.S. Pat. No. 4,631,071.

TREAT RATES

The concentration of the additive (B) in the fuel oil may for example be in the range of 1 to 5,000 ppm (active ingredient) by weight per weight of fuel, for example 5 to 5,000 ppm such as 5 to 2000 ppm (active ingredient) by weight per weight of fuel, preferably 5 to 500 ppm more preferably 5 to 200 ppm.

The concentration of additive (A) (antifoam) in the fuel oil may, for example, be in the range of 0.5 to 5,000 ppm (active ingredient) by weight per weight of fuel such as 0.5 to 200 ppm, preferably 0.5 to 25 ppm, more preferably 0.5 to 15 ppm, such as 0.5 to 5 ppm (e.g. 1, 2, 3, or 4 ppm).

Component (B) is known as a flow improver additive in fuel oils and it is found in this invention that, when used at treat rates where it is active as a flow improver additive (e.g. above 200 ppm), it enhances the antifoam properties of component (A). It is further found in this invention that, when component (B) is used at treat rates below those at which it is active as a flow improver additive, (e.g. less than 200 ppm, such as 1–50, preferably 1–15 such as 4–12, more preferably 1–10 ppm), it still enhances the antifoam properties of component (A).

A benefit of the invention is thus that the invention is applicable when cold flow properties are not required, e.g. in the summer, by using a low treat rate of component (B), and also when cold flow properties are required, e.g. in the winter, by using a high treat rate of component (B).

A further benefit of the present invention is that components (A) and (B) can be added in combination to the fuel oil, thereby optimising and controlling their combined antifoam effect in relation to treat rate. If they are added separately, it may not be possible to take account of their synergy and more of a component than is necessary may be added.

CO-ADDITIVES

The additives of the invention may be used singly or as mixtures. They may also be used in combination with one or more other co-additives such as known in the art, for example the following: detergents, antioxidants, corrosion inhibitors, dehazers, demulsifiers, metal deactivators, cetane improvers, cosolvents, package compatibilisers, and lubricity additives. Also, other flow improvers may be used as co-additives, examples including ethylene/unsaturated ester copolymers, and comb polymers which are discussed below.

Ethylene copolymer flow improvers, i.e. ethylene unsaturated ester copolymer flow improvers, have a polymethylene backbone divided into segments by oxyhydrocarbon side chains.

More especially, the copolymer may comprise an ethylene copolymer having, in addition to units derived from ethylene, units of the formula $$—CR^5R^6—CHR^7—$$

wherein $R^6$ represents hydrogen or a methyl group;

$R^5$ represents a —$OOCR^8$ or —$COOR^8$ group wherein $R^8$ represents hydrogen or a $C_1$ to $C_{28}$, preferably $C_1$ to $C_9$, straight or branched chain alkyl group, provided that $R^8$ does not represent hydrogen when $R^5$ represents —$COOR^8$; and $R^7$ is hydrogen or —$COOR^8$.

These may comprise a copolymer of ethylene with an ethylenically unsaturated ester, or derivatives thereof. An example is a copolymer of ethylene with an ester of an unsaturated carboxylic acid, but the ester is preferably one of an unsaturated alcohol with a saturated carboxylic acid. An ethylene-vinyl ester copolymer is advantageous; an ethylene-vinyl acetate, ethylene vinyl propionate, ethylene-vinyl hexanoate, or ethylene-vinyl octanoate copolymer is preferred. Preferably, the copolymers contain from 1 to 25, e.g. 1 to 20, mole % of the vinyl ester, more preferably from 3 to 15 mole % vinyl ester. They may also be in the form of mixtures of two copolymers such as those described in U.S. Pat. No. 3,961,916. Preferably, number average molecular weight, as measured by vapour phase osmometry, of the copolymer is 1,000 to 10,000, more preferably 1,000 to 5,000. If desired, the copolymers may be derived from additional comonomers, e.g. they may be terpolymers or tetrapolymers or higher polymers, for example where the additional comonomer is isobutylene or diisobutylene.

The copolymers may be made by direct polymerisation of comonomers. Such copolymers may also be made by transesterification, or by hydrolysis and re-esterification, of an ethylene unsaturated ester copolymer to give a different ethylene unsaturated ester copolymer. For example, ethylene vinyl hexanoate and ethylene vinyl octanoate copolymers may be made in this way, e.g. from an ethylene vinyl acetate copolymer.

Comb polymers are discussed in "Comb-Like Polymers. Structure and Properties", N. A. Platé and V. P. Shibaev, J. Poly. Sci. Macromolecular Revs., 8, p 117 to 253 (1974).

Generally, comb polymers have one or more long chain branches such as hydrocarbyl branches, such as oxyhydrocarbyl branches, having from 10 to 30 carbon atoms, pendant from a polymer backbone, said branch or branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer having, or a copolymer at least 25 and preferably at least 40, more preferably at least 50, molar per cent of the unts of which have, side chains containing at least 6, and preferably at least 10, atoms, selected from for example carbon, nitrogen and oxygen, in a linear chain.

As examples of preferred comb polymers there may be mentioned those containing units of the general formula

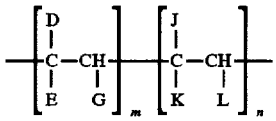

where

D=$R^{11}$, $COOR^{11}$, $OCOR^{11}$, $R^{12}COOR^{11}$ or $OR^{11}$

E=H, $CH_3$, D or $R^{12}$

G=H or D

J=H, $R^{12}$, $R^{12}COOR^{11}$, or an aryl or heterocyclic group

K=H, $COOR^{12}$, $OCOR^{12}$, $OR^{12}$ or COOH

L=H, $R^{12}$, $COOR^{12}$, $OCOR^{12}$ or aryl $R^{11} \geqq C_{10}$ hydrocarbyl $R^{12} \geqq C_1$ hydrocarbyl and m and n represent mole ratios, their sum being 1 and m being finite and being up to and including 1 and n being from zero to less than 1, preferably m being within the range of from 1.0 to 0.4, n being in the range of from 0 to 0.6. $R^{11}$ advantageously represents a hydrocarbyl group with from 10 to 30 carbon atoms, and $R^{12}$ advantageously represents a hydrocarbyl group with from 1 to 30 carbon atoms.

The comb polymer may contain units derived from other monomers if desired or required. It is within the scope of the invention to include two or more different comb copolymers.

These comb polymers may be copolymers of maleic anhydride or fumaric acid and another ethylenically unsaturated monomer, e.g. an a-olefin or an unsaturated ester, for example, vinyl acetate. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, and 1-octadecene.

The copolymer may be esterified by any suitable technique and although preferred it is not essential that the maleic anhydride or fumaric acid be at least 50% esterified. Examples of alcohols which may be used include n-decan-1-ol, n-dodecan-1-ol, n-tetradecan-1-ol, n-hexadecan-1-ol, and n-octadecan-1-ol. The alcohols may also include up to one methyl branch per chain, for example, 1-methylpentadecan-1-ol, 2-methyltridecan-1-ol. The alcohol may be a mixture of normal and single methyl branched alcohols. It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such as for example those described in European Patent Applications 153 176, 153 177 and 225 688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred fumarate comb polymers may, for example, have a number average molecular weight in the range of 1,000 to 100,000, preferably 1,000 to 30,000, as measured by Vapour Phase Osmometry (VPO).

Other suitable comb polymers are the polymers and copolymers of alpha-olefins and esterified copolymers of styrene and maleic anhydride, and esterified copolymers of styrene and fumaric acid; mixtures of two or more comb polymers may be used in accordance with the invention and, as indicated above, such use may be advantageous.

Other examples of comb polymers are hydrocarbon polymers such as copolymers of ethylene and at least one α-olefin, preferably the α-olefin having at most 20 carbon atoms, examples being n-decene-1 and n-dodecene-1. Preferably, the number average molecular weight of such a copolymer is at least 30,000. The hydrocarbon copolymers may be prepared by methods known in the art, for example using a Ziegler type catalyst.

Examples of other flow improver additives include hydrocarbon polymers (e.g. ethylene—lower alpha olefin [e.g. propylene] copolymers), and compounds such as described in EP-A-61895, JP 2-51477 and 3-34790, EP-A-117,108, EP-A-326,356 and EP-A-356,256.

Mono- or poly-carboxylic acids such as benzoic acid may be included as stabilisers.

CONCENTRATES

Concentrates are convenient as a means for incorporating the additives into bulk fuel oil, which incorporation may be done by methods known in the art. The concentrates may also contain other additives as required and preferably contain from 3 to 75 wt %, more preferably 3 to 60 wt %, most preferably 10 to 50 wt % of the additives preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; and paraffinic hydrocarbons such as hexane and pentane and isoparaffins. The carrier liquid must, of course, be selected having regard to its compatibility with the additives and with the fuel.

The additives of the invention may be incorporated into the fuel oil by other methods such as those known in the art. If co-additives are required, they may be incorporated into the bulk oil at the same time as the additives of the invention or at a different time.

EXAMPLES

The following examples illustrate the invention, in which the following materials were used and the following test was carried out.

Fuels

Fuels A and B, characterised as follows, were used

| | A | B |
|---|---|---|
| Specific Density | 0.8398 | 0.833 |
| Cloud Point (°C.) | −6 | −9 |

Distillation Characteristics (°C.)

| | | |
|---|---|---|
| IBP | 163.0 | |
| 10% | | 201 |
| 20% | 233 | |
| 50% | 277 | 250 |
| 90% | 333 | 321 |
| 95% | 347 | |
| FBP | 367 | 357 |

Additives

Antifoam: a polyoxyalkylene modified dimethyl polysiloxane.

Polar N Compound: a N,N-dialkylammonium salt of 2—$N^1$,$N^1$-dialkylamidobenzoate, being the reaction product of reacting one mole of phthalic anhydride with two moles of dihydrogenated tallow amine to form a half amide/half amine salt.

Test

Samples of the fuels were treated with various additive combinations and, in each test, agitated vigorously and the time, in seconds, for the foam to collapse observed. The initial foam height was also measured and the untreated and treated fuels compared. The examples were carried out at ambient temperature. Additive treat rates are indicated in the examples below in parts per million (ppm) by weight.

Example 1

Results obtained in Fuel A were as follows:

| Additive (treat rate, ppm) | Collapse Time (sec) | Foam Height Reduction (%) |
|---|---|---|
| Untreated | 26 | 0 |
| Antifoam (12.5) | 12 | 26 |
| Polar N Compound (200) | 23 | 6 |
| Antifoam (12.5) + Polar N Compound (200) | 5 | 70 |

Thus, the polar N compound enhances the antifoam properties of the anti-foam.

Example 2

Results obtained in Fuel B were as follows:

| Additive (treat rate, ppm) | Collapse Time (sec) | Foam Height Reduction (%) |
|---|---|---|
| Untreated | 23 | 0 |
| Antifoam (12.5) | 9 | 60 |
| Polar N Compound (200) | 21 | 5 |
| Antifoam (12.5) + Polar N Compound (200) | 3 | 70 |

Again, the polar N compound enhances the antifoam properties of the antifoam.

Example 3

Further results obtained in Fuel A were as follows:

| Additive (treat rate, ppm) | Collapse Time (sec) | Foam Height Reduction (%) |
|---|---|---|
| Untreated | 30 | 0 |
| Antifoam (10) | 10 | 43 |

-continued

| Additive (treat rate, ppm) | Collapse Time (sec) | Foam Height Reduction (%) |
|---|---|---|
| Antifoam (2) + Polar N Compound (224) | 10 | 43 |
| Antifoam (2) + Polar N Compound (224) + nonyl phenol (50 | 9 | 43 |
| Antifoam (2) + Polar N Compound (224) + benzoic acid (50) | 8 | 43 |

Thus, use of the polar N compound enable 8 ppm less of antifoam to be used to obtain the same anti-foam properties. Antifoam performance was further enhanced by additions of nonyl phenol and of benzoic acid.

The additives also contained a fumarate comb polymer co-additive, other co-additives known in the art and solvents.

Example 4

Further results obtained in a diesel fuel of the following characteristics were as follows:

| Specific Density (15° C.) Distillation Characteristics (°C.) | 0.8365 |
|---|---|
| IBP | 195 |
| 10% | 222 |
| 20% | 233 |
| 50% | 264 |
| 90% | 331 |
| 95% | 351 |
| FBP | 370 |

| Additive (treat rate, ppm) | 1 | 2 | 4 | 8 | 15 | 22 |
|---|---|---|---|---|---|---|
| | | | (Days) | | | |
| Untreated | 39 | 45 | | 41 | 44 | 45 |
| Antifoam (4) | 4 | 8 | 11 | 13 | 22 | |
| Antifoam (8) | | 8 | 10 | 13 | 14 | |
| Antifoam (12) | 0 | 2 | | 5 | 8 | 13 |
| Antifoam (8) + Polar N Compound (4) | 0 | 4 | | 6 | 9 | 15 |
| Antifoam (8) + Polar N Compound (12) | 0 | 4 | | 6 | 11 | 22 |

The above results indicate foam collapse time in seconds after an indicated number of days and show that very low treat rates of the Polar N Compound were effective in enhancing the antifoam performance of the Antifoam and that such enhancement is retained over a period of time.

We claim:

1. A fuel oil composition comprising a major proportion of a middle distillate fuel oil and a minor proportion of both additives (A) and (B) wherein additive (A) comprises from about 0.5 to about 5000 ppm by weight active ingredient of a fuel oil antifoam which is a siloxane-containing composition, and additive (B) comprises from about 1 to about 5000 ppm by weight active ingredient of an oil-soluble polar nitrogen compound carrying one or more substituents of the formula —$NR^1$— or a cation salt thereof, where $R^1$ represents a hydrocarbyl group containing 8 to 40 carbon atoms.

2. A fuel oil composition of claim 1 wherein the siloxane-containing composition is a block copolymer containing siloxane blocks and polyoxylalkylene blocks.

3. A fuel oil composition of claim 1 wherein the oil-soluble polar nitrogen compound is an amine salt and/or amide formed by reacting at least one molar proportion of a hydrocarbyl substituted amine with a molar proportion of a hydrocarbyl acid having 1 to 4 carboxylic acid groups or its anhydride, the substituent(s) of formula —$NR^1$— being of the formula—$NR^1R^2$ where $R^1$ is defined as in claim 1 and $R^2$ represents hydrogen or $R^1$, provided that $R^1$ and $R^2$ may be the same or different, said substituents constituting part of the amine salt and/or amide groups of the compound.

4. A fuel oil composition of claim 3 wherein at least one of $R^1$ and $R^2$ represent a straight chain alkyl group having from 14 to 24 carbon atoms.

5. A fuel oil composition of claim 1 wherein the oil-soluble polar nitrogen compound comprises or includes a cyclic ring system carrying at least two substituents of the formula —A—$NR^1R^2$ wherein A is an aliphatic hydrocarbyl group that is optionally interrupted by one or more hetero atoms and that is straight chain or branched, and $R^1$ is defined as in claim 1 and $R^2$ is independently $R^1$.

6. A fuel oil composition of claim 1 wherein the oil-soluble polar nitrogen compound is a condensate of a primary amine of formula $R^1NH_2$ or a secondary amine of formula $R^1R^2NH$ with a carboxylic acid-containing polymer wherein $R^1$ is defined as in claim 1 and $R^2$ is independently $R^1$.

7. A fuel oil composition of claim 1 which comprises 0.5 to 15 ppm by weight of additive (A) antifoam per weight of fuel oil.

8. A fuel oil composition of claim 7 which comprises 0.5 to 5 ppm by weight of additive (A) antifoam per weight of fuel oil.

9. A fuel oil composition of claim 1 wherein the fuel oil is a diesel fuel.

10. A fuel oil composition of claim 7 which comprises 1 to 50 ppm by weight of additive (B) per weight of fuel oil.

11. A fuel oil composition of claim 10 wherein there is 1 to 15 ppm of additive (B).

12. A fuel oil composition of claim 2 wherein the block polymer containing siloxane blocks and polyoxyalkylene blocks is a polyoxyalkylene modified dimethyl polysiloxane.

13. A fuel oil composition of claim 12 wherein the oil soluble polar nitrogen compound of additive (B) is a N,N-dialkylammonium salt of 2-N',N'-dialkylamidobenzoate, being the reaction product of reacting one mole of phthalic anhydride with two moles of dehydrogenated tallow amine to form a half amide/half amine salt.

14. A method of enhancing the acceleration of foam collapse and reduced initial foam height properties of middle distillate fuel oil obtained from an antifoam which is a siloxane containing composition, which method comprises adding to the fuel oil a minor proportion of both additives (A) and (B) wherein additive (A) comprises from about 0.5 to about 5000 ppm by weight active ingredient of a fuel oil antifoam which is a siloxane-containing composition, and additive (B) comprises from about 1 to about 5000 ppm by weight active ingredient of an oil-soluble polar nitrogen compound carrying one or more substituents of the formula —$NR^1$— or a cation salt thereof, where $R^1$ represents a hydrocarbyl group containing 8 to 40 carbon atoms.

15. A method of claim 14 wherein the siloxane-containing composition is a block copolymer containing siloxane blocks and polyoxylalkylene blocks and the oil-soluble polar nitrogen compound is an amine salt and/or amide formed by reacting at least one molar proportion of a hydrocarbyl substituted amine with a molar proportion of a hydrocarbyl acid having 1 to 4 carboxylic acid groups or its anhydride, the substituent(s) of formula —$NR^1$— being of the formula —$NR^1R^2$ where $R^1$ is defined as in claim 1 and $R^2$ represents hydrogen or $R^1$, provided that $R^1$ and $R^2$ may be the same or different, said substituents constituting part of the amine salt and/or amide groups of the compound.

16. A method of claim 15 wherein the block copolymer containing siloxane blocks and polyoxyalkylene blocks is a polyoxyalkylene modified dimethyl polysiloxane.

17. A method of claim 16 wherein the oil soluble polar nitrogen compound of additive (B) is a N,N-dialkylammonium salt of 2-N',N'-dialkylamidobenzoate, being the reaction product of reacting one mole of phthalic anhydride with two moles of dehydrogenated tallow amine to form a half amide/half amine salt.

18. A fuel oil composition comprising a major proportion of a middle distillate fuel oil and a minor proportion of additives (A) and (B) wherein additive (A) comprises from about 0.5 to about 15 ppm by weight active ingredient of an antifoam which is a polyoxyalkylene modified dimethyl polysiloxane, and additive (B) comprises from about 5 to about 500 ppm by weight active ingredient of an oil soluble polar N,N-dialkylammonium salt of 2-N'N'-dialkylamidobenzoate, being the reaction product of reacting one mole of phthalic anhydride with two moles of dehydrogenated tallow amine to form a half amide/half amine salt.

* * * * *